US008737639B1

(12) United States Patent
Ribeiro et al.

(10) Patent No.: US 8,737,639 B1
(45) Date of Patent: May 27, 2014

(54) VOICE AMPLIFICATION ASSEMBLY

(76) Inventors: Peter Ribeiro, New Haven, CT (US); Kimberley Ribeiro, New Haven, CT (US)

( * ) Notice: Subject to any disclaimer, the term of this patent is extended or adjusted under 35 U.S.C. 154(b) by 313 days.

(21) Appl. No.: 13/112,486

(22) Filed: May 20, 2011

(51) Int. Cl.
*H04R 27/00* (2006.01)

(52) U.S. Cl.
USPC ..... 381/82; 381/79; 381/120

(58) Field of Classification Search
CPC ..... H04R 27/00; H04B 5/00
USPC ..... 381/77, 75, 74, 79, 82, 120; 455/569.1
See application file for complete search history.

(56) References Cited

U.S. PATENT DOCUMENTS

| | | | | |
|---|---|---|---|---|
| 4,596,041 | A | 6/1986 | Mack | |
| 4,882,773 | A | 11/1989 | Maloney | |
| D310,368 | S | 9/1990 | Derhaag et al. | |
| 5,323,257 | A * | 6/1994 | Abe et al. | 398/129 |
| 6,987,949 | B2 | 1/2006 | Taniguchi et al. | |
| 7,869,608 | B2 * | 1/2011 | Sander et al. | 381/113 |
| 2005/0276426 | A1 * | 12/2005 | Ono et al. | 381/104 |
| 2008/0031470 | A1 * | 2/2008 | Angelhag | 381/77 |
| 2008/0081470 | A1 * | 4/2008 | Clark | 438/680 |
| 2008/0205669 | A1 | 8/2008 | Michelet | |
| 2009/0047905 | A1 | 2/2009 | Yang | |
| 2010/0142723 | A1 * | 6/2010 | Bucklen | 381/81 |
| 2012/0308034 | A1 * | 12/2012 | El-Hoiydi | 381/77 |

* cited by examiner

*Primary Examiner* — Disler Paul

(57) ABSTRACT

A voice amplification assembly is provided for facilitating amplification of a voice for public speaking. The assembly provides a portable wireless microphone and a base unit operationally couplable to a pre-existing speaker. A transceiver is positioned in the base unit. The microphone has a transmitter which is operationally coupled to the transceiver. A processor is positioned in base unit and operationally coupled to the transceiver for adjusting and outputting an audio signal received from the microphone through the transceiver. An audio control is operationally coupled to the processor for inputting an adjustment to the audio signal. An output port is configured for connecting to an existing speaker to broadcast the audio signal.

2 Claims, 4 Drawing Sheets

VOICE AMPLIFICATION ASSEMBLY

BACKGROUND OF THE DISCLOSURE

1. Field of the Disclosure

The disclosure relates to public address systems and more particularly pertains to a new public address system for facilitating amplification for public speaking by providing a portable wireless microphone and a base unit operationally couplable to a pre-existing speaker.

2. Summary of the Disclosure

An embodiment of the disclosure meets the needs presented above by generally comprising a base unit and a transceiver positioned in the base unit. A microphone having a transmitter is operationally coupled to the transceiver. A processor is positioned in base unit and operationally coupled to the transceiver for adjusting and outputting an audio signal received from the microphone through the transceiver. An audio control is operationally coupled to the processor for inputting an adjustment to the audio signal. An output port is configured for connecting to an existing speaker to broadcast the audio signal.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
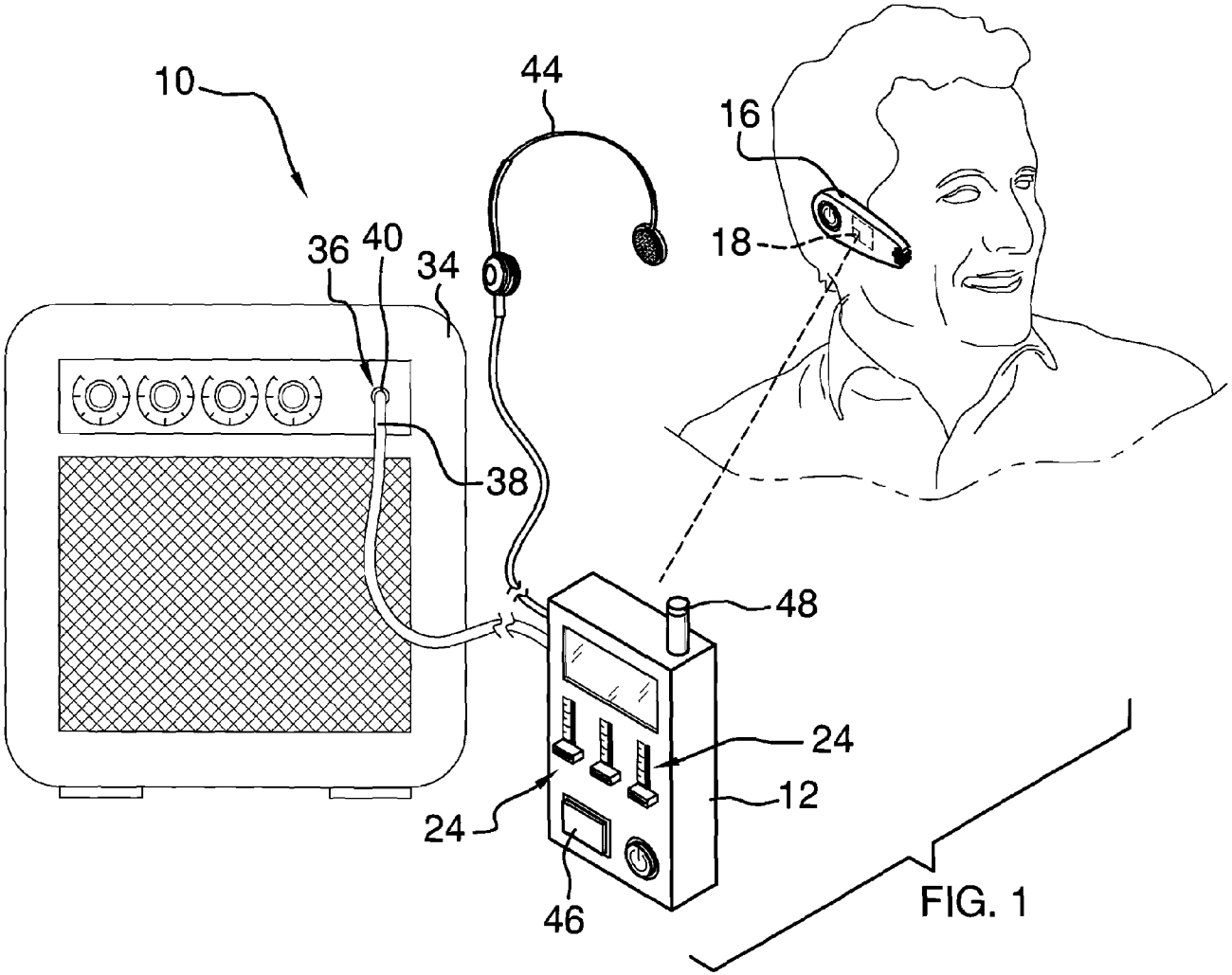
FIG. 1 is a top front side perspective view of a voice amplification assembly according to an embodiment of the disclosure in use.
Figure 2:
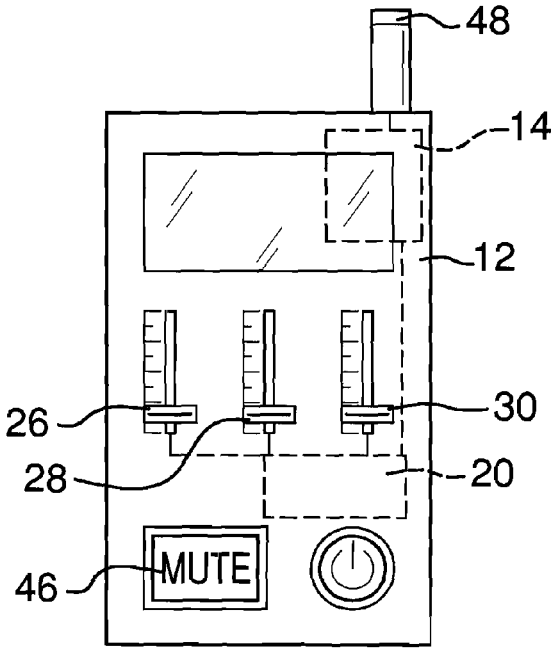
FIG. 2 is a front view of an embodiment of the disclosure.
Figure 3:
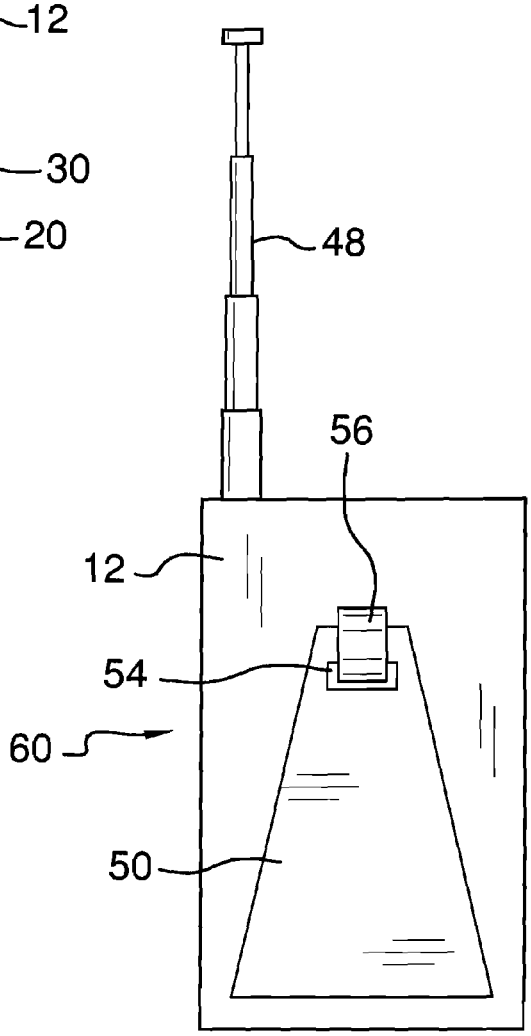
FIG. 3 is a back view of an embodiment of the disclosure.
Figure 4:
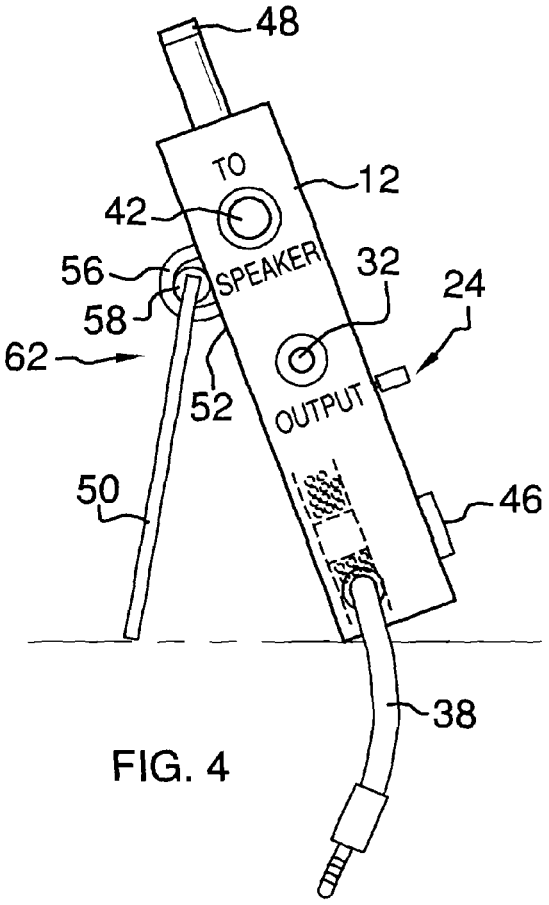
FIG. 4 is a side view of an embodiment of the disclosure.
Figure 5:
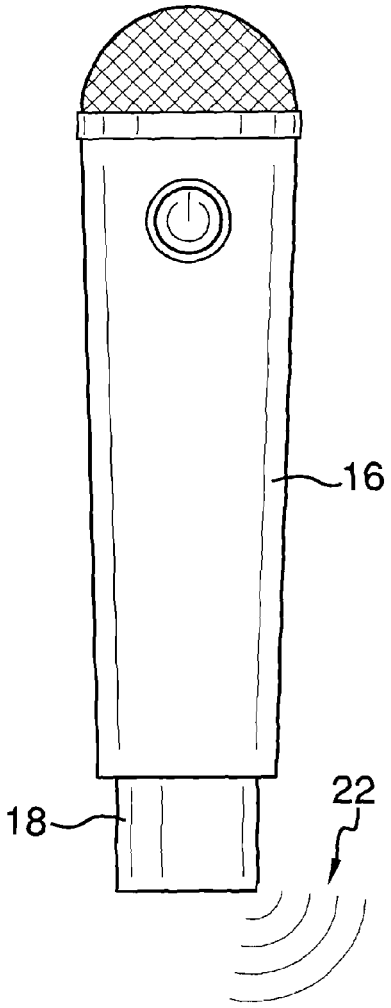
FIG. 5 is a front view of an embodiment of the disclosure.
Figure 6:
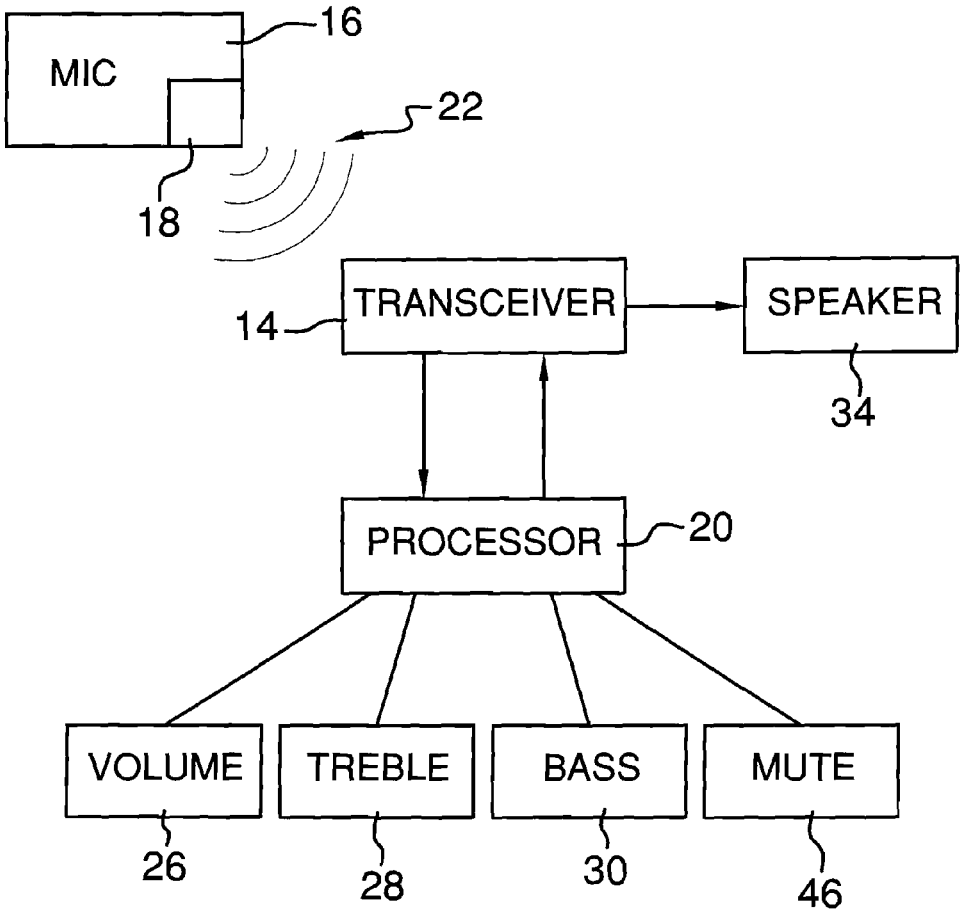
FIG. 6 is a schematic view of an embodiment of the disclosure.

With reference now to the drawings, and in particular to FIGS. 1 through 6 thereof, a new public address system embodying the principles and concepts of an embodiment of the disclosure and generally designated by the reference numeral 10 will be described.

As best illustrated in FIGS. 1 through 6, the voice amplification assembly 10 generally comprises a base unit 12, a transceiver 14 positioned in the base unit 12, and a microphone 16 which has a transmitter 18 operationally coupled to the transceiver 14. A processor 20 is also positioned in base unit 12. The processor 20 is operationally coupled to the transceiver 14 for receiving, adjusting and outputting an audio signal 22 received from the microphone 16 through the transceiver 14.

A plurality of audio controls 24 is positioned on the base unit 12 for inputting adjustments to the audio signal 22. The audio controls 24 are operationally coupled to the processor 20 for inputting adjustments to the audio signal 22. The audio controls 24 include a volume control 26, a treble pitch control 28, and a bass pitch control 30. The audio controls 24 may be sliding knobs, rotary knobs or a combination of both sliding and rotary to facilitate distinguishing between the various functions by touch.

An output port 32 may be operationally coupled to the processor 20 and configured for connecting to an existing speaker 34 through an audio input 36 to broadcast the audio signal 22 through the speaker 34. A cord 38 may be coupled to and extend from the output port 32 of the base unit 12. The cord 38 is configured for coupling to the existing speaker 34 by a connector 40 coupled to a distal end 42 of the cord 38 relative to the base unit 12. The connector 40 may be a standard rca connector or other standardized connector configured for electronically coupling to the existing speaker 34. Adapters may also be used to enhance the potential for connecting to different types of electronic devices having various forms of audio input ports. Alternatively, the cord 38 may be coupled to the base unit 12 and retractable into the base unit 12. The retractable alternative can be provided in combination with the output port 32 to maximize connectivity.

A headphone port 42 may be coupled to the base unit 12. The headphone port 42 is operationally coupled to the processor 20 for outputting the audio signal 22 through a headphone set 44. A mute button 46 may be coupled to the base unit 12 and operationally coupled to the processor 20 for selectively preventing the audio signal 22 from being transmitted by the processor 20. An extendable antenna 48 may be coupled to the base unit 12 and operationally coupled to the transceiver 14 for enhancing reception of the transceiver 14.

A triangular stand member 50 may be coupled to a rear surface 52 of the base unit 12. The stand member 50 may have a connection aperture 54. A loop 56 extends from the rear surface 52 and through the connection aperture 54. A tubular spacer 58 may be coupled to the stand member 50 to abut the loop 56 as the stand member 50 is pivoted between a retracted position 60 and an extended position 62.

In use, the base unit 12 is connected to the existing speaker 34 which is intended to be found at a given location where voice amplification is desired. This may be at a party, a meeting, a sporting event, or any other similar situation. The base unit 12 is activated and the microphone 16, which may be a traditional wand type or part of a headset or earpiece, is used to wirelessly transmit the user's voice through the speaker 34. The processor 20 and audio controls 24 permit adjustment to the audio signal 24 which is output from the speaker 34.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A voice amplification assembly comprising:

a base unit;

a transceiver positioned in said base unit;

a microphone having a transmitter operationally coupled to said transceiver;

a processor positioned in base unit, said processor being operationally coupled to said transceiver for adjusting and outputting an audio signal received from said microphone through said transceiver;

a plurality of audio controls positioned on said base unit, said audio controls being operationally coupled to said processor for inputting an adjustment to said audio signal, said audio controls including a volume control, said audio controls including a treble pitch control, said audio controls including a bass pitch control;

an output port configured for connecting to an existing speaker to broadcast said audio signal;

a cord coupled to and extending from said output port of said base unit, said cord being configured for coupling to the existing speaker;

a connector coupled to a distal end of said cord relative to said base unit, said connector being configured for electronically coupling to the existing speaker;

a triangular stand member coupled to a rear surface of said base unit, said stand member being pivotable between a retracted position and an extended position;

a headphone port coupled to said base unit, said headphone port being operationally coupled to said processor whereby said headphone port is configured for outputting said audio signal through a headphone set;

an output cord port coupled to said base unit, said output cord port being operationally coupled to said processor whereby said output cord port is configured for outputting said audio signal through the existing speaker;

a mute button coupled to said base unit, said mute button being operationally coupled to said processor for selectively preventing said audio signal from being transmitted by said processor; and an antenna coupled to said base unit, said antenna being operationally coupled to said transceiver for enhancing reception of said transceiver.

2. The assembly of claim 1, wherein said cord is retractable into said base unit.

* * * * *